US009949032B1

(12) United States Patent
Johnson et al.

(10) Patent No.: US 9,949,032 B1
(45) Date of Patent: Apr. 17, 2018

(54) DIRECTIVITY SPEAKER ARRAY

(71) Applicant: Apple Inc., Cupertino, CA (US)

(72) Inventors: Martin E. Johnson, Los Gatos, CA (US); Tom-Davy W. Saux, Los Altos, CA (US); Justin D. Crosby, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,211

(22) Filed: Sep. 23, 2016

Related U.S. Application Data

(60) Provisional application No. 62/232,858, filed on Sep. 25, 2015.

(51) Int. Cl.

| | |
|---|---|
| ***H04R 5/02*** | (2006.01) |
| ***H04R 1/34*** | (2006.01) |
| *H04R 1/28* | (2006.01) |
| *H04R 5/04* | (2006.01) |

(52) U.S. Cl.
CPC ..... *H04R 5/02* (2013.01); *H04R 1/345* (2013.01); *H04R 1/288* (2013.01); *H04R 5/04* (2013.01); *H04R 2203/12* (2013.01)

(58) Field of Classification Search
CPC ..... H04R 5/02; H04R 1/345; H04R 1/288; H04R 2203/12; H04R 5/04
See application file for complete search history.

(56) References Cited

U.S. PATENT DOCUMENTS

2002/0191807 A1* 12/2002 Asada ..... H04R 5/02 381/335
2008/0101631 A1* 5/2008 Jung ..... H04S 3/00 381/307
2017/0238091 A1* 8/2017 Johnson ..... H04R 1/403 381/335

* cited by examiner

*Primary Examiner* — Andrew L Sniezek
(74) *Attorney, Agent, or Firm* — Robert C. Kowert; Meyertons, Hood, Kivlin, Kowert & Goetzel, P.C.

(57) ABSTRACT

Some embodiments provide a directivity speaker array, comprising multiple driver assemblies, which is configured to provide audio signal patterns, which include audio content, to one or more listeners where the signal patterns are associated with at least a certain threshold directivity across a range of frequencies in which the array can transition between the providing audio signal patterns via beamforming of signals generated by multiple driver assemblies and via an individual driver assembly, based on overlapping frequency ranges at which such provided audio signal patterns are associated with at least the certain threshold directivity. A driver assembly can include a release duct which progressively releases an audio signal generated by a coupled driver, via perforations in a perforated surface, as the signal propagates along a surface of an enclosure of the duct such that an intensity of the audio signal is maximized along the particular axis of propagation.

19 Claims, 7 Drawing Sheets

DIRECTIVITY SPEAKER ARRAY

This application claims benefit of priority of U.S. Provisional Application Ser. No. 62/232,858, filed Sep. 25, 2015, which is hereby incorporated by reference herein in its entirety.

BACKGROUND

Technical Field

This disclosure relates generally to stereo speaker arrays, and in particular to a speaker array which provides separate signals of audio content to multiple separate listeners over a wide range of audio frequencies.

Description of the Related Art

Stereo sound systems provide a stereo sound experience to a listener based on providing separate channels of audio content which correspond to separate directions out of separate audio speakers, also referred to herein as drivers. The drivers are often positioned with respect to a design position of the listener, so that a driver configured to provide a "left" channel is positioned to the listener's left, and another driver configured to provide a "right" channel is positioned to the listener's right. Collectively the drivers can provide a virtual stereo sound stage, also referred to herein as a stereo image, for the listener where the listener can perceive certain sounds as emanating from various directions, including from virtual sound sources. Sounds intended to be heard from the left end of the sound stage can be preferentially provided via a left driver, so that the listener perceives the sounds as emanating from a sound source to the left of the listener, and sounds intended to be heard from the right end of the sound stage can be preferentially provided via a right driver, so that the listener perceives the sounds as emanating from a sound source to the right of the listener. Furthermore, sounds intended to be heard from the center of the sound stage can be provided equally via both a right and left driver, so that the listener perceives the sounds as emanating from a virtual sound source positioned between the drivers.

In some cases a driver array generates an audio signal which includes a signal pattern which is shaped based on a directivity of the audio signal, wherein an intensity of the signal at various directions relative to the array is based on one or more of a frequency of the signal, an angle of the signal, etc.

SUMMARY OF EMBODIMENTS

Some embodiments provide an apparatus which includes a directivity speaker array which is configured to provide a plurality of separate stereo images of audio content to each of a plurality of listeners. The array includes a set of driver assemblies which collectively generate a signal pattern, via beamforming of separate audio signals generated by the separate driver assemblies, which is associated with a directivity index which at least meets a threshold directivity index within a first range of signal frequencies. The driver assemblies also individually generate, by at least one driver assembly of the set of driver assemblies, another signal pattern which is associated with another directivity index which at least meets the threshold directivity index within a second range of signal frequencies. The first range of signal frequencies and second range of signal frequencies at least partially overlap, such that the set of driver assemblies are configured to seamlessly transition between generating a signal pattern which is associated with a directivity index which at least meets the threshold directivity index across the first and second ranges of signal frequencies.

Some embodiments provide an apparatus which includes a driver assembly configured to generate an audio signal which is directed along a particular axis. The driver assembly includes a release duct which further includes an enclosure which extends, from a duct inlet, along a particular axis and is bound, on opposite sides, by a surface of the enclosure and a perforated surface. The release duct progressively releases an audio signal, which propagates from the duct inlet and along the enclosure surface through the enclosure, through perforations in the perforated surface along the particular axis as the signal propagates along the enclosure surface away from the duct inlet, such that an intensity of the audio signal is maximized along the particular axis.

Some embodiments provide a method which includes configuring a directivity speaker array to provide a plurality of separate stereo images of audio content to each of a plurality of listeners. The configuring includes providing a plurality of driver assemblies and coupling a particular quantity of the driver assemblies together, such that duct inlets of adjacently coupled driver assemblies, of the particular quantity of driver assemblies, are spaced apart by a particular spacing distance. Each driver assembly includes a driver coupled to a duct inlet of a separate release duct and individually generates a signal pattern which is associated with a directivity index which at least meets a threshold directivity index within a first range of signal frequencies. The coupling is based on a set of determinations that the particular quantity of driver assemblies and the particular spacing distance between the duct inlets of the adjacently coupled driver assemblies is associated with generating signal patterns, via beamforming of separate audio signals generated by the separate driver assemblies, which are associated with directivity indices which at least meet the threshold directivity index within a second range of signal frequencies; and the first range of signal frequencies and second range of signal frequencies at least partially overlap, such that the particular quantity of driver assemblies are configured to seamlessly transition between generating a signal pattern which is associated with a directivity index which at least meets the threshold directivity index across the first and second ranges of signal frequencies.

DETAILED DESCRIPTION

Figure 1:
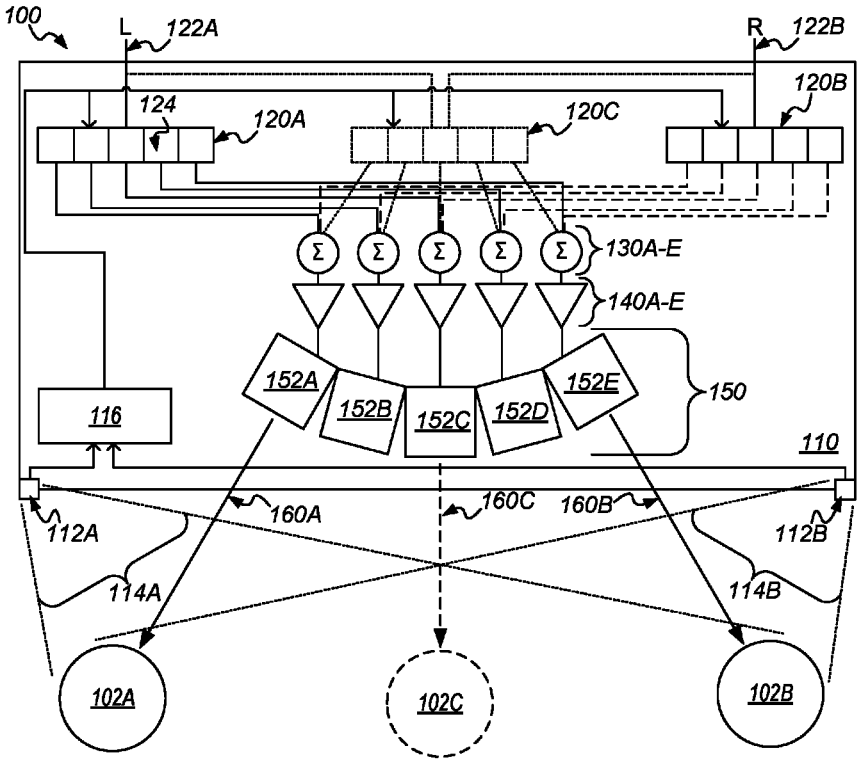
FIG. 1 illustrates a schematic block diagram of a directivity speaker array, according to some embodiments.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that some embodiments may be practiced without these specific details. In other instances, well-known methods, procedures, components, circuits, and networks have not been described in detail so as not to unnecessarily obscure aspects of the embodiments.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

"Comprising." This term is open-ended. As used in the appended claims, this term does not foreclose additional structure or steps. Consider a claim that recites: "An apparatus comprising one or more processor units . . . ." Such a claim does not foreclose the apparatus from including additional components (e.g., a network interface unit, graphics circuitry, etc.).

"Configured To." Various units, circuits, or other components may be described or claimed as "configured to" perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. §112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

It will also be understood that, although the terms first, second, etc. may be used herein to describe various elements, these elements should not be limited by these terms. These terms are only used to distinguish one element from another. For example, a first contact could be termed a second contact, and, similarly, a second contact could be termed a first contact, without departing from the intended scope. The first contact and the second contact are both contacts, but they are not the same contact. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

The terminology used in the description herein is for the purpose of describing particular embodiments only and is not intended to be limiting. As used in the description and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

FIG. 1 illustrates a schematic block diagram of a directivity speaker array, according to some embodiments. Some or all of the array 110 illustrated in FIG. 1 can be included in any of the embodiments of arrays included in any of the embodiments herein.

In some embodiments, a speaker array includes multiple speakers, also referred to herein as drivers, which are configured to collectively provide one or more signal patterns comprising one or more instances of audio content to one or more listeners based on adjustably providing two or more separate channels of the audio content through one or more of the various drivers in the array, thereby at least partially providing stereo images of the one or more instances of audio content to one or more listeners. As a result, a listener can be provided with a spatial perspective of various sounds included in the audio content, including a perspective of direction and proximity of one or more sound sources to the listener. The stereo image is also referred to herein as a stereo sound stage, as the listener can perceive, via the stereo image, a relative position and direction of various sound sources as if the sound sources were physically positioned in a multi-dimensional stage, image, etc.

In some embodiments, to controllably adjust one or more sets of drivers in an array to cause the array to provide separate stereo images to separate listeners, the array includes one or more sets of sensor devices which can monitor the environment in which the array is located. The array can, based at least in part upon processing sensor data representations of the environment which are generated by the sensor devices, identify listeners in the environment, including relative positions of the listeners, hearing organs of the listeners, etc. in the environment. The array can adjustably control the signals generated by drivers included in the array based on the identification of listeners so that signal patterns which are directed to the separate listeners from at least one set of drivers in the array are at least partially restricted from propagating to other listeners.

Based on the determined positions of listeners in the environment, one or more portions of the array can adjustably control one or more filter banks which filter one or more channels of audio content for one or more particular drivers in a set of drivers so that separate signals generated by the set of drivers propagate towards particular listeners and area at least partially restricted from propagating to other listeners via one or more various techniques, including beamforming.

In some embodiments, propagation of a signal, signal pattern, etc. towards a particular direction can be referred to interchangeably as referring to an intensity, magnitude, etc. of the signal in the particular direction.

FIG. 1 shows an environment 100 in which an array 110 and listeners 102A-B are located. Array 110 includes a set of sensor devices 112A-B which monitor 114A-B one or more portions of the environment 100 in which the listeners are located. The one or more sensor devices 112A-B can include one or more camera devices, light beam scanning devices, ultrasonic sensor devices, radar devices, some combination thereof, etc. A sensor device can generate a sensor data representation of the portion of the environment which is monitored by the sensor device.

Sensor data generated by the sensor devices 112A-B can be provided to a processor 116 which processes the sensor data generated by sensor devices 112A-B and, based at least in part upon the processing, identifies the listeners 102A-B in the environment 100, including identifying relative positions of the listeners 102A-B relative to the array 110.

Based on the determined positions of the listeners 102A-B relative to array 110, processor 116 determines a configuration of one or more various banks 120 of audio filters 124 which results in the driver assemblies 152 of a set 150 provided the output of said filters directing separate signals of audio content towards the separate listeners, where the configuration results in a given signal pattern directed towards a particular listener is controlled to at least partially be restricted from propagating to another listener. Such control can include determining a filter bank configuration which results in a signal directed towards a given listener featuring a "notch", based on beamforming, signal phase control, etc. which is directed towards another listener so that the other listener is at least partially precluded from receiving the signal directed towards the given listener. In some embodiments, processor 116 configuration of one or more various banks 120 of audio filters 124 which results in the driver assemblies 152 of a set 150 provided the output of said filters directing separate signals of audio content towards the separate listeners in separate signal patterns which are associated with separate directivity indices which results in each separate signal pattern being shaped to maximize signal sensitivity in a direction towards a particular listener and to minimize signal sensitivity in a direction towards at least one other particular listener.

As shown, the output of the processor 116 is communicated to various filter banks 120A-B which each correspond to a separate channel 122A-B of audio content received at the array 110. The output of the processor 116 can include command signals generated based on a selected filter bank configuration which, when received at the various filter banks 120A-B, causes the filter banks to be adjustably controlled to adjustably control the output of the various filters 124 in the various banks 120 according to the determined filter bank configuration at processor 116. As shown, bank 120A of filters 124 receives left channel content 122A and bank 120B of filters 124 receives right channel content 122B. Each separate filter 124 in a given bank 120 corresponds to a separate driver assembly 152 in set 150 and the output of a given filter in a bank 120 is provided to a particular driver assembly 152. As discussed further below, outputs from separate filters in separate banks can be provided to a common driver.

The separate filters 124 in the separate banks 120A-B are adjustably controlled by the processor 116 based on the determined positions of the listeners 102A-B so that the outputs of the various filter banks 120A-B, when combined by the summation elements 130A-E and passed through separate amps 140A-E to separate drivers 152A-E, result in the driver assemblies 152A-E at least partially collectively providing separate signals 160A-B which are directed towards particular separate listeners 102A-B and are at least partially restricted from being directed towards other listeners.

As shown in FIG. 1, in some embodiments, the array 110 is configured to direct more than two separate signals to two separate listeners. In some embodiments, the array 110 is configured to adjustably control particular filter banks to cause one or more of the driver assemblies 152 to provide a particular signal which is directed towards a particular listener and is at least partially restricted from propagating towards the particular direction of one or more other particular listeners. For example, where an additional listener 102C is located between listeners 102A-B, processor 116 can identify the location of the listener 102 based on processing sensor data generated by the sensor devices 112A-B monitoring the environment and can determine a filter bank configuration which directs separate signals 160A-C to the separate listeners 102A-C so that each signal 160 is directed towards the position of a particular listener 102 and is at least partially restricted from propagating towards at least one other of the listeners. As shown, the array 110 can include one or more filter banks 120C which can filter content from multiple channels 122A-B and can provide an output which causes one or more of the drivers 152 to direct signal 160C to listens 102C. In some embodiments, bank 120C is absent and banks 120A-B are adjustably controlled to provide outputs which, when provided to driver assemblies 152, cause the driver assemblies 152 to provide at least the three separate signals 160A-C which are directed towards the three separate listeners 102A-C.

In some embodiments, a set 130 of drivers included in the array 110 are arranged to direct at least some of the driver assemblies 152 in separate directions, as shown in FIG. 1. In some embodiments, directionality of a signal generated at one or more various driver assemblies 152 in a set 130 is based at least in part upon a frequency of the signal. As the frequency of the signal increases, the directionality of a signal pattern provided by a given driver, also referred to as the directivity index associated with the signal pattern, can increase, such that a particular directional signal 160A-C with a sufficiently high frequency can be directed to a particular listener, while at least partially restricting the signal from being directed to another listener, via generating the signal at one or more drivers which are physically directed towards the listener.

For example, in FIG. 1, where signal patterns 160A-C are of sufficiently high directivity to at least meet a certain directivity index threshold, based at least in part upon signal frequency at least meeting a certain threshold value, such that a determination can be made that the signal pattern can be directed to a given listener independent of other listeners via an individual driver, driver assembly 152A alone can direct signal pattern 160A to listener 102A independently of listeners 102B-C, based on driver assembly 152A being physically directed towards listener 102A. Similarly, driver assembly 152C can generate signal pattern 160C directed towards listener 102C and driver assembly 152B can generate signal pattern 160B directed towards listener 102B.

As a result, the set of driver assemblies 152 is configured to provide signal patterns to separate listeners, while restricting said signals from propagating towards other listeners, across a broad spectrum of signal frequencies which includes frequencies at which the signals become highly directional. In some embodiments, the processor 116 selects a particular filter bank configuration based on a determination that a directivity index of a signal pattern generated as a result of the particular filter bank configuration at least meets a certain directivity index threshold. In some embodiments, the processor 116 adjusts the selected filter bank configuration based on variations in frequency of one or more signal patterns, so that the provided signal pattern is associated with a sufficiently great directivity index to at least meet the threshold directivity index. Such adjustment can include selecting configurations which result in the signal pattern being switched between being generated via beamforming of signals generated by multiple driver assemblies and being generated via individual generation by an individual driver assembly.

Figure 2A:
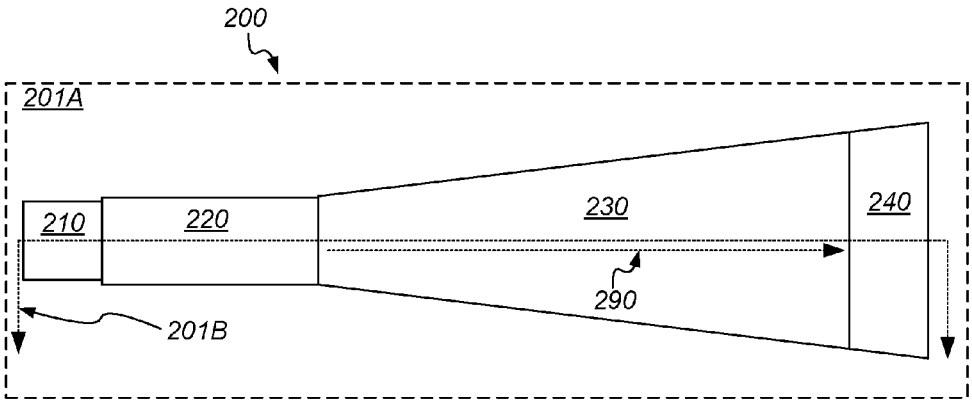
FIG. 2A-B illustrate schematic block diagrams of a driver assembly which is configured to generate one or more audio signals which are directed along an enclosure surface of the driver assembly, according to some embodiments.
Figure 2B:
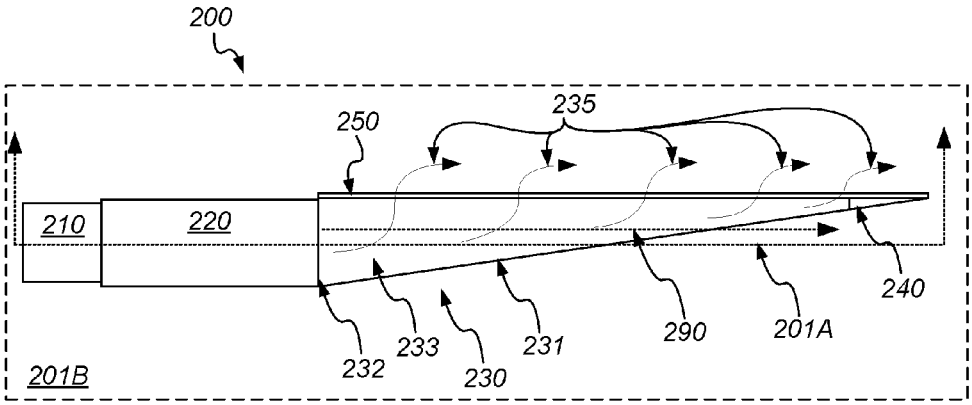

FIG. 2A-B illustrate schematic block diagrams of a driver assembly which is configured to generate one or more audio signals which are directed along an enclosure surface of the driver assembly, according to some embodiments. Some or all of the assembly 200 illustrated in FIG. 2 can be included in any of the embodiments of arrays included in any of the embodiments herein.

In some embodiments, a driver is comprised in a driver assembly which includes ducting configured to controllably direct audio signals generated by the driver, so that the audio signals, signal patterns, etc. generated by the driver are provided, via the ducting, with an associated directivity index which at least meets a threshold directivity index at a certain range of frequencies. An assembly can be configured to space the duct inlets, of the ducting included in separate driver assemblies which are coupled together, apart by a certain spacing distance which is closer than if the drivers were positioned adjacent to each other and to cause the wavefronts of audio signals generated by each separate driver to be smoothed prior to the separate signals generated by separate drivers being blended together.

In some embodiments, a driver assembly includes a release duct which enables an audio signal generated by a driver, and routed to the release duct via the speaker duct, to be progressively released, or "leaked", out of the release duct as the signal propagates along a surface of the release duct, The effect of such a configuration is that the progressively released signal, which progressively leaks out of the release duct as the signal propagates along the duct surface, causes the release duct to simulate the operation of a series of transducers which operate in a delayed sequence along an axis of propagation of the signal and which each generate a separate instance of the signal in a delayed operation along the surface of the release duct as the signal propagates. The result of such an effect is that the directivity index of the signal pattern provided by the release duct is controlled to maximize signal pattern intensity in the general direction of the propagation axis of the signal through the release duct, which can include reducing the signal pattern intensity in other directions, including directions orthogonal to the propagation axis.

In some embodiments, the driver assembly comprises a release duct which is bounded, on at least one end, with a resistive material which at least partially encloses an enclosure of the release duct. The release duct is configured to enable progressive leaking of an audio signal entering the release duct, as the signal propagates along an enclosure surface of the release duct and along a particular propagation axis, via the resistive material into an external environment. In some embodiments, the resistivity of the material can vary along a length of the material away from the release duct inlet along the propagation axis.

In some embodiments, the release duct includes one or more instances of absorptive material at a distal end of the release duct from the duct inlet, where the adsorptive material is configured to at least partially mitigate reflections of a signal arriving at the material from propagating through the release duct from the duct inlet along the propagation axis, thereby at least partially mitigating vibration of the release duct.

In some embodiments, a driver assembly includes a speaker duct which couples the driver to the inlet of the release duct. The speaker duct can be shaped to enable the inlets of the release ducts, and thus the driver assemblies, to be spaced closer together than if the drivers of each assembly were coupled directly to the inlets of the release ducts. As a result, the drivers can be larger than the pacing between the assemblies, and the speaker duct can be shaped in a curvature and can include one or more drivers in the interior of the duct which controls the aliasing frequency of the driver assembly.

FIG. 2A illustrates an overhead view 201 of the assembly 200, where the assembly includes a driver which is coupled to an inlet 232 of a speaker duct 220 which couples the driver to a release duct. As shown, the release duct 230 can be wedge shaped, where an enclosure 233 of the duct narrows in depth and widens in width as it extends away from the inlet duct 232 along the propagation axis 290. FIG. 2B shows a side view 201B of the assembly 200 and illustrates that a resistive material 250 can extend over an enclosure 233 of the release duct 230, opposite from a surface 231 of the enclosure extending away from the inlet 232 of the release duct, and is configured to enable progressive release 235 of an audio signal generated by the driver 210 and propagated to the duct 230 via speaker duct 220, where the resistive material 250 causes the signal to progressively release 235 through the material 250 and out of the duct 230 as the signal propagates along surface 231 and along propagation axis 290 away from the inlet 232. As also shown, the release duct includes adsorptive material 240.

In some embodiments, the assembly 200, configured to enable progressive release of the signal 235 from the release duct 230 as it propagates away from inlet 232 along axis 290 and across the enclosure surface 231, results in the signal 235 associated directivity index being augmented, so that the intensity of the signal in the direction of propagation of the signal from inlet 232, propagation axis 290, is greater than the intensity of the signal in other directions. The speaker duct 220 can be shaped in one or more various curvatures and can include one or more internal dividers which can at least partially adjust the frequencies at which signals propagating through the duct 220 reflect between interior walls of the duct 220.

Figure 3A:
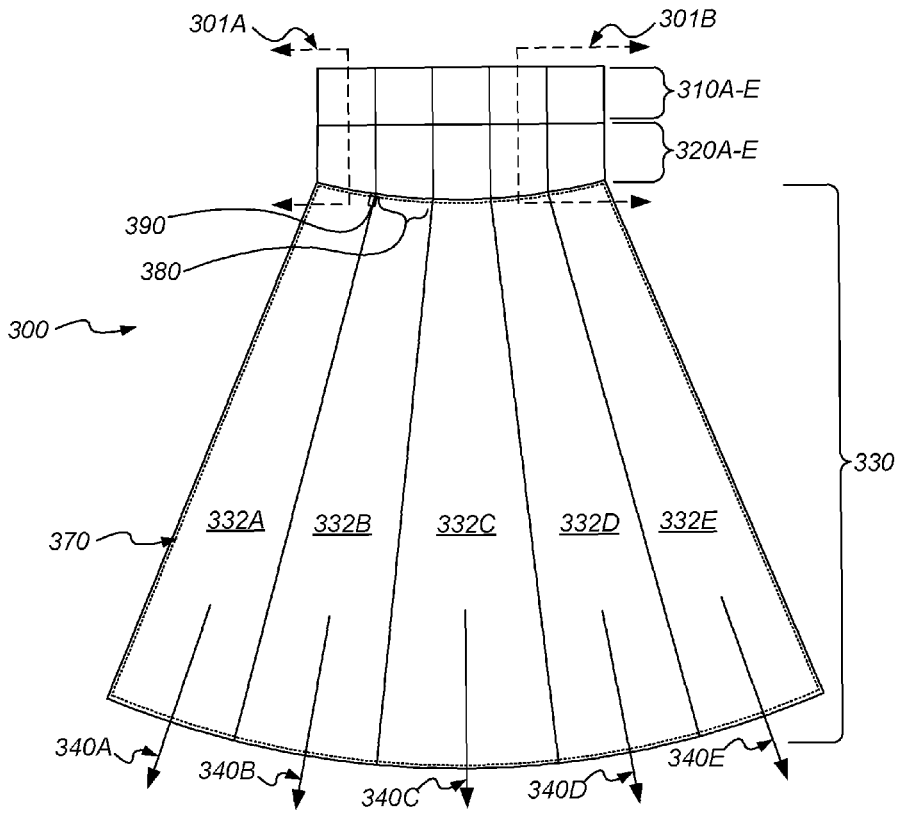
FIG. 3A-C illustrate a schematic block diagrams of a set of driver assemblies, according to some embodiments.
Figure 3B:
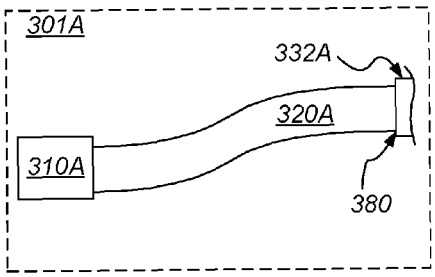
Figure 3C:
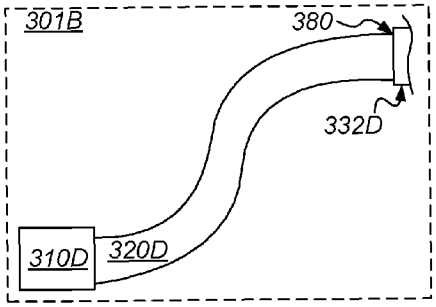

FIG. 3A-C illustrate a schematic block diagrams of a set of driver assemblies, according to some embodiments. Some or all of the set 300 illustrated in FIG. 3A-C can be included in any of the embodiments of arrays included in any of the embodiments herein.

As shown, in FIG. 3A-C, a set of driver assemblies 300 can include multiple separate drivers 310A-E which are each coupled to a separate release duct 332A-E inlet 380 via separate instances of speaker ducts 320A-E.

As shown, the separate inlets 380 of the separate release ducts 332A-E can be spaced apart by a certain spacing distance 390. The spacing distance 390 can be selected based on a determined frequency at which the array drivers transition between providing a signal pattern via collective beamforming and an individual driver providing the signal, based on aliasing. In some embodiments, the transition frequency associated with aliasing is proportional to the inverse of the spacing distance, such that reducing the spacing distance increases the transition frequency. The spacing distance can be controlled to balance the transition frequency against beamforming performance, as insufficient spacing can result in reduced beamforming performance. In some embodiments, the spacing distance 390 can be selected based on one or more of a determined frequency range within which the array driver assemblies, spaced according to the spacing distance, provide signal patterns associated with directivity indices which at least meet a threshold directivity index via collective beamforming, a determined frequency range within which at least one array driver assembly of the assemblies individually provides signal patterns associated with directivity indices which at least meet a threshold directivity index. As referred to herein, providing a signal, signal pattern, etc. can be referred to interchangeably as generating a signal, signal pattern, etc.

In some embodiments, an upper frequency at which beamforming of a signal pattern via operation of the drivers 310A-E is associated with the quantity of driver assemblies which include the corresponding quantity of drivers 310A-E, the spacing distance 390 between adjacent inlets 380 of adjacently coupled driver assemblies, some combination thereof, etc.

In some embodiments, the speaker ducts 320A-E included in separate driver assemblies of the set are shaped differently so that the inlet 380 of the release ducts 332 are spaced closer together than the drivers 310A-E can be placed adjacently. As shown in FIG. 3B-C, the speaker duct 320A, C, E coupling drivers 310A, C, E to separate inlets 380 of release ducts 332A, C, E comprises a mild s-shape curvature, while the speaker ducts 320B, D coupling drivers 310B, D to separate inlets 380 of release ducts 332B, D comprise greater s-shape curves which result in drivers 310B, D being positioned at a separate elevation relative to drivers 310A, C, E. As a result, the ducts 320A-E can be positioned to couple to separate release duct 332A-E inlets 380 which are spaced closer together than the drivers 310A-E coupled to the separate speaker ducts 320A-E. One or more of the speaker ducts can include one or more internal dividers which increase the frequency at which signals propagating through the speaker ducts reflect between internal walls of the speaker ducts.

In some embodiments, the separate release ducts 332A-E can be included in a single component 330 which includes separate inlets 380 which are each spaced by a certain distance 390 and to which separate speaker ducts 320 can be coupled. An individual instance of resistive material 370 can be coupled to the device 300 so that the material 370 extends over each of the enclosures included in each of the ducts 332A-E.

As shown, the release ducts 332A-E are shaped to cause signals 340A-E generated by the separate drivers 310A-E to be directed in different directions. Where the directivity index associated with a signal pattern exceeds a certain threshold, the signal pattern can be generated by an individual driver, so that the signal pattern is directed towards a particular position based on the driver and corresponding release duct via which the signal pattern is provided.

Figure 4A:
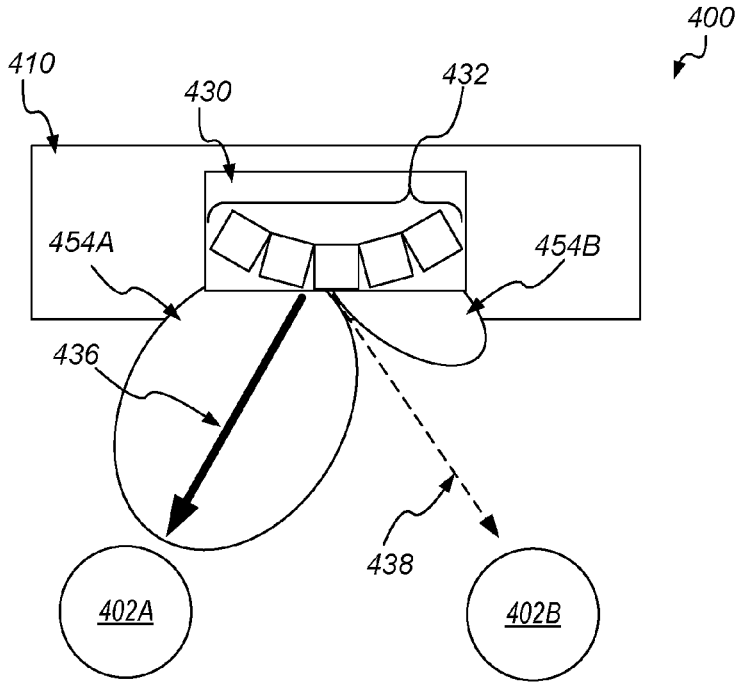
FIG. 4A-B illustrate a schematic block diagram of a directive speaker array, according to some embodiments.
Figure 4B:
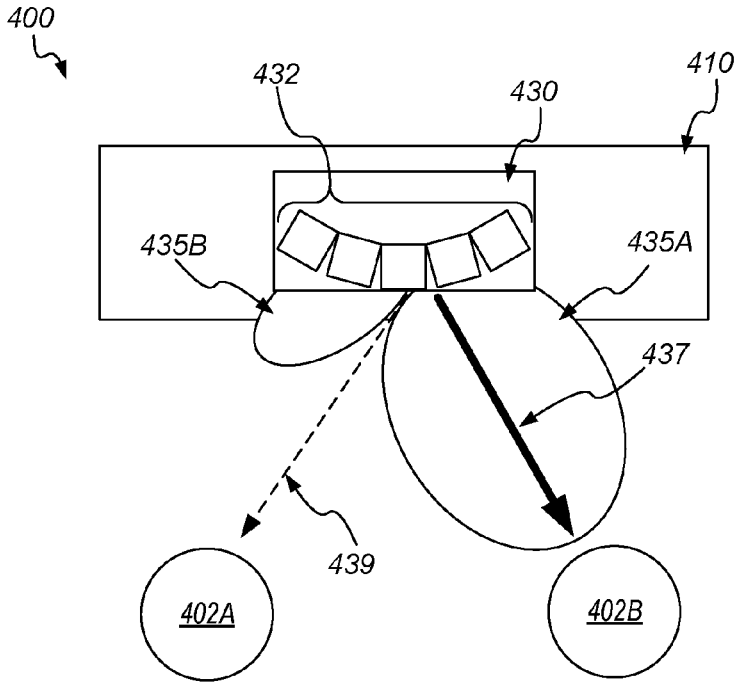

FIG. 4A-B illustrate a schematic block diagram of a directive speaker array, according to some embodiments. Some or all of the array 410 illustrated in FIG. 4A-B can be included in any of the embodiments of arrays included in any of the embodiments herein.

As shown, in FIG. 4A-B, the set 430 of driver assemblies 432 can be adjustably controlled, via controlling one or more of phase, frequency; beamforming, etc., to adjust the propagation, associated directivity index, etc. of multiple separate audio signal patterns through an environment so that at least one audio signal pattern, also referred to herein as an "audio directivity pattern", "signal pattern", etc., is shaped to propagate towards a target listener at is at least partially restricted from propagating towards at least one other listener. Set 430 of driver assemblies 432 collectively direct 436 the signal in a signal pattern 434A-B which is shaped to propagate towards listener 402A and further features a "notch" 438 in the shape of the pattern 434A-B where the signal is at least partially absent and which is directed, as shown by arrow 438, towards listener 402B. The shape of the pattern 434 can be based on the directivity index associated with the pattern, where shaping the pattern 434 as shown in FIG. 4A comprises adjusting the directivity index associated with the pattern so that the directivity index, or sensitivity of the pattern 434, in the direction 436 of the listener 402A is maximized (i.e., propagation in the direction 436 is maximized) and the directivity index, or sensitivity of the pattern 434, in the direction 438 of the listener 402B is minimized As a result, listener 402A receives the signal included in the signal pattern 434, and the signal pattern 434, and thus the signal, is at least partially restricted from being received by listener 402B. Similarly, set 430 of drivers 432 collectively direct another signal directed 437 towards listener 402B in a signal pattern 435A-B which is shaped to propagate towards listener 402B and further features a "notch" 439 in shape of the pattern 435 where the signal is at least partially absent and which is directed 439 towards listener 402A. As a result, listener 402B receives signal 437, and the signal is at least partially restricted from being received by listener 402A.

In some embodiments, the audio content comprised in the signal pattern 434 is separate from the audio content comprised in the signal pattern 435, so that the separate listeners 402A-B are provided with separate instances of audio content.

Figure 5:
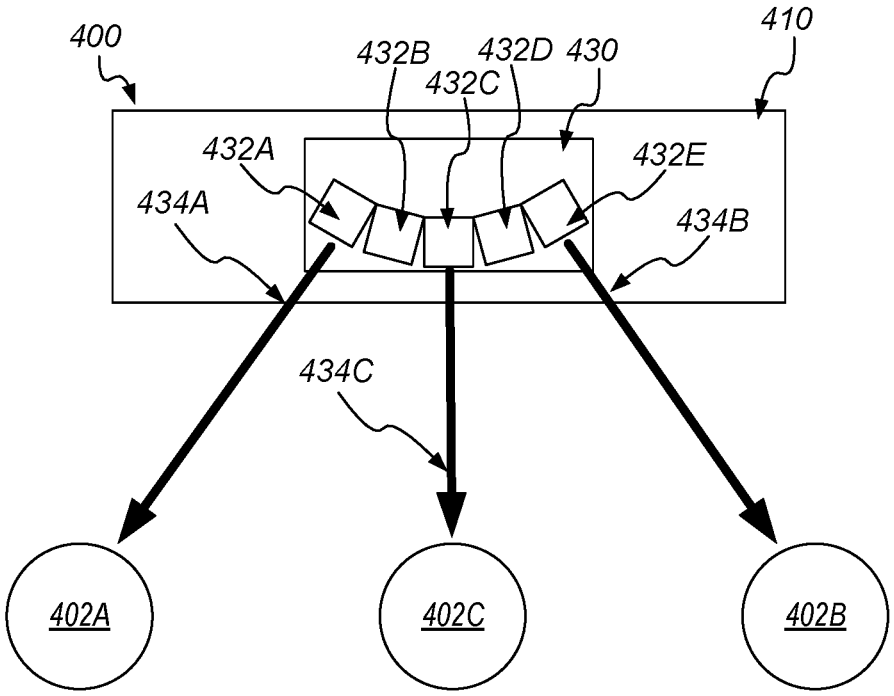
FIG. 5 illustrates a schematic block diagram of a directive speaker array, according to some embodiments.

FIG. 5 illustrates a schematic block diagram of a directive speaker array, according to some embodiments. Some or all of the array 410 illustrated in FIG. 4A-B can be included in any of the embodiments of arrays included in any of the embodiments herein.

In some embodiments, a frequency of one or more signal patterns provided by a driver assembly set to various listeners is sufficiently high so the pattern to be generated, with a directivity index associated with the signal pattern which at least meets a certain threshold directivity index, by an individual driver assembly. As shown in FIG. 5, where the frequency associated with separate signal patterns 434A-C at least meets one or more threshold values, the separate signal patterns can be provided to the separate listeners 402A-C via individual driver assemblies 432A, C, E, while driver assemblies 432B, D are inactive, where the separate patterns 434A-C are each associated with sufficiently great directivity indices to each be received by a separate listener 402A-C independently of other listeners 402A-C.

The embodiments shown in FIG. 4-5 can indicate providing signal patterns, to separate listeners, which each include a respective associated directivity index which at least meets a certain threshold. Where the frequency of the signal pattern is less than a certain threshold, generating a signal pattern at an individual driver assembly at the given frequency which at least meets the threshold directivity may be at least partially precluded, and generating the signal pattern at the given frequency which at least meets the threshold directivity can comprise generating the signal pattern via beamforming of multiple signals generated at multiple driver assemblies. Similarly, where the frequency of the signal pattern exceeds another certain threshold, beamforming the signal pattern can degrade due to decreased size of the waves included in the separate signals generated at the separate driver assemblies at least partially precluding beamforming of the separate signal into a particular signal pattern.

As described above, the set of drivers can be configured so that the lower frequency bound of individual driver-generated signal patterns having sufficient directivity is less than the upper frequency bound of multiple-driver beamformed signal patterns, having sufficient directivity, thereby enabling a seamless transition between providing sufficiently directive signal patterns via individual driver assemblies and beamforming signals generated by multiple driver assemblies to form the sufficiently directive signal pattern. Such configuring can include coupling a particular quantity of driver assemblies into the set, spacing the release duct inlets apart by a certain distance, etc.

In some embodiments, an array comprises multiple sets of drivers, including one or more sets of woofer devices, tweeter devices, etc. and the various sets of devices can be selectively utilized to generate a signal pattern based on one or more frequencies of the signal pattern. Low-frequency signal patterns can be generated by one or more subwoofer devices, based on a determination that a frequency of the signal pattern is less than a threshold lower bound frequency associated with beamforming the signal pattern via multiple separate driver assemblies in a set of driver assemblies.

Figure 6:
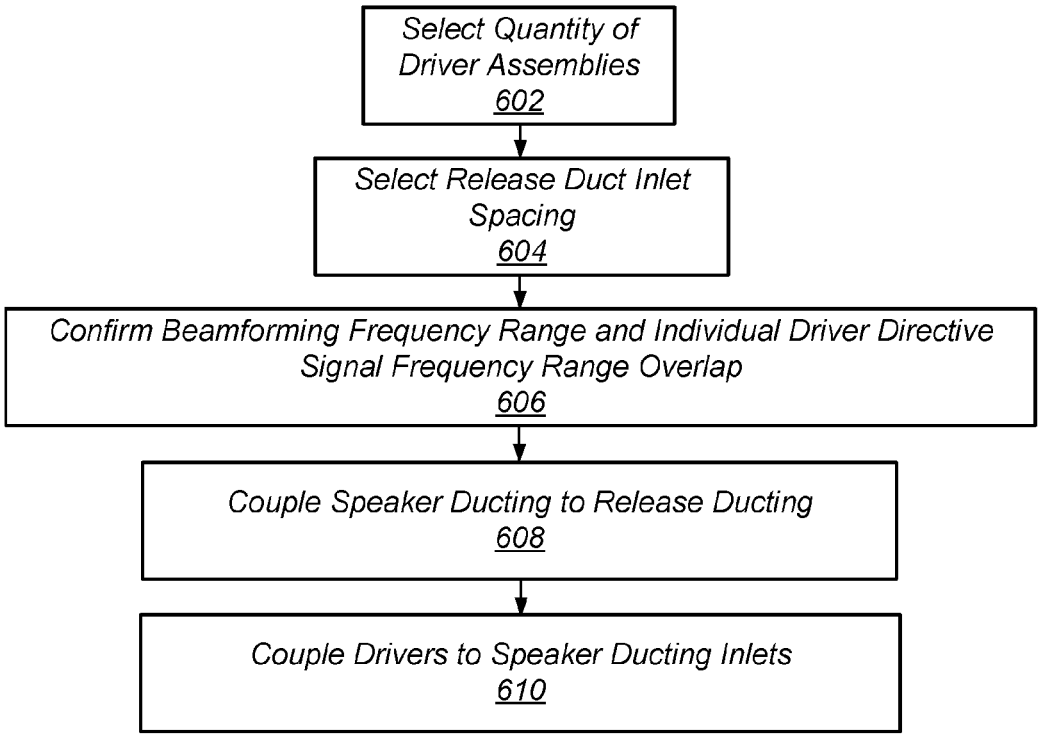
FIG. 6 illustrates configuring a stereo image array to provide multiple separate signal patterns which are directed to separate listeners, according to some embodiments.

FIG. 6 illustrates configuring a stereo image array to provide multiple separate signal patterns which are directed to separate listeners, according to some embodiments. The providing can be implemented by one or more portions of any embodiment of the multi-listener stereo imaging array included in any embodiments herein. One or more portions of the array can be implemented by one or more computer systems.

At 602 and 604, a quantity of driver assemblies to include in the array and a spacing of the release duct inlets in the array are determined. The quantity and spacing can be determined based on the frequency ranges at which individual drive-generated signal patterns have a directivity which at least meets a threshold level and at which a signal pattern generated based on beamforming of signals generated by multiple driver assemblies. At 606, the individual-driver and beamforming frequency ranges are determined to overlap, so that seamless transitions between beamforming a signal pattern and generating the signal patter from an individual driver is enabled. As referred to herein, a seamless transition between beamforming a signal pattern and generating the signal patter from an individual driver includes a transition between beamforming the signal pattern and generating the signal patter from an individual driver independently of a change in directivity index of the generated signal patterns, such that audio perception of the transition, by one or more listeners, is at least partially inhibited. At 608, one or more instance of speaker ducting configured to couple the quantity of drivers, selected at 602, to separate release duct inlets are coupled to a set of release duct inlets which are spaced according to the selected spacing at 604. At 610, the selected quantity of drivers are each coupled to separate ones of the speaker ducts.

Figure 7:
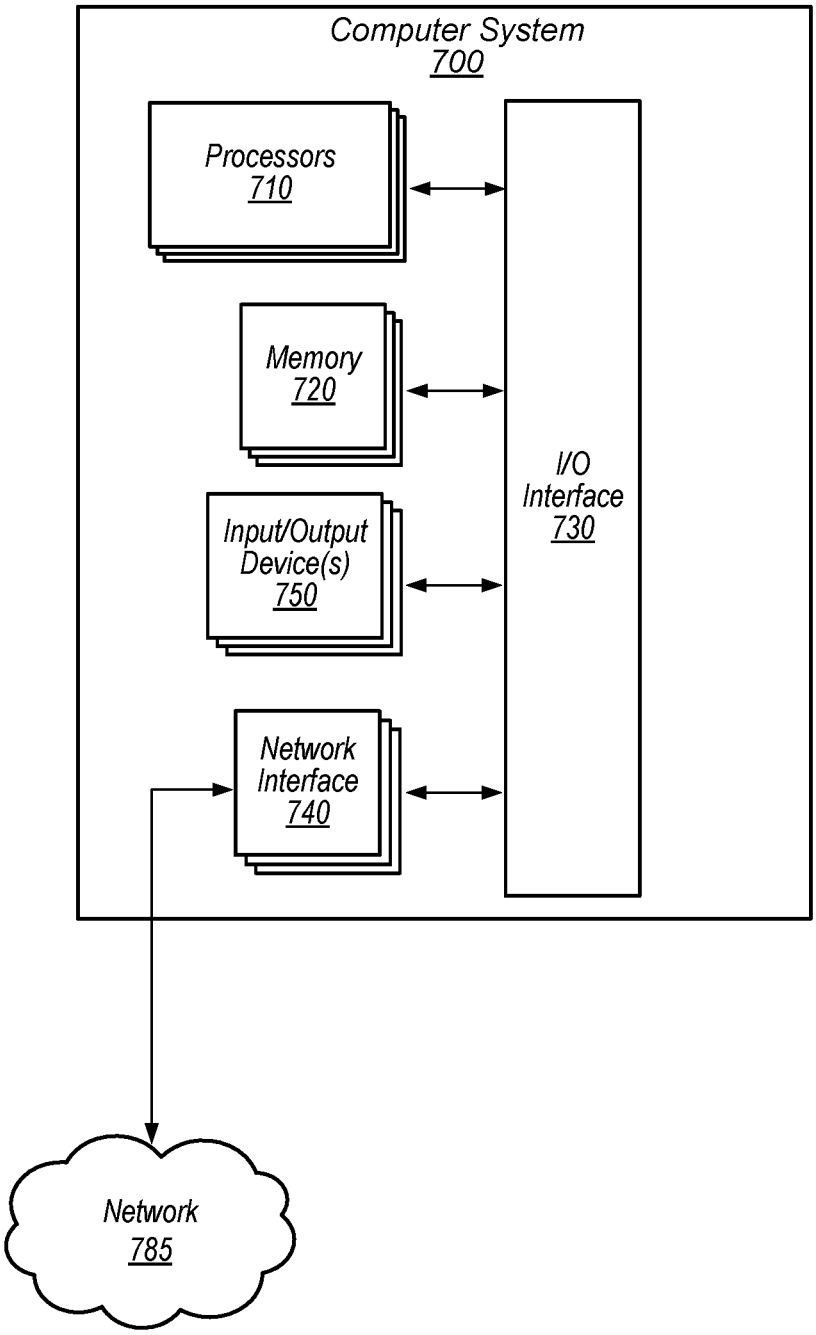
FIG. 7 illustrates a computer system that may be configured to include or execute any or all of the embodiments described herein.

FIG. 7 illustrates an example computer system 700 that may be configured to include or execute any or all of the embodiments described above. In different embodiments, computer system 700 may be any of various types of devices, including, but not limited to, a personal computer system, desktop computer, laptop, notebook, tablet, slate, pad, or netbook computer, cell phone, smartphone, PDA, portable media device, mainframe computer system, handheld computer, workstation, network computer, a camera or video camera, a set top box, a mobile device, a consumer device, video game console, handheld video game device, application server, storage device, a television, a video recording device, a peripheral device such as a switch, modem, router, or in general any type of computing or electronic device.

Various embodiments of directivity speaker array, as described herein, may be executed in one or more computer systems 700, which may interact with various other devices. Note that any component, action, or functionality described above with respect to FIGS. 1 through 6 may be implemented on one or more computers configured as computer system 700 of FIG. 7, according to various embodiments. In the illustrated embodiment, computer system 700 includes one or more processors 710 coupled to a system memory 720 via an input/output (I/O) interface 730. Computer system 700 further includes a network interface 740 coupled to I/O interface 730, and one or more input/output devices, which can include one or more user interface (also referred to as "input interface") devices. In some cases, it is contemplated that embodiments may be implemented using a single instance of computer system 700, while in other embodiments multiple such systems, or multiple nodes making up computer system 700, may be configured to host different portions or instances of embodiments. For example, in one embodiment some elements may be implemented via one or more nodes of computer system 700 that are distinct from those nodes implementing other elements.

In various embodiments, computer system 700 may be a uniprocessor system including one processor 710, or a multiprocessor system including several processors 710 (e.g., two, four, eight, or another suitable number). Processors 710 may be any suitable processor capable of executing instructions. For example, in various embodiments processors 710 may be general-purpose or embedded processors implementing any of a variety of instruction set architectures (ISAs), such as the x86, PowerPC, SPARC, or MIPS ISAs, or any other suitable ISA. In multiprocessor systems, each of processors 710 may commonly, but not necessarily, implement the same ISA.

System memory 720 may be configured to store program instructions, data, etc. accessible by processor 710. In various embodiments, system memory 720 may be implemented using any suitable memory technology, such as static random access memory (SRAM), synchronous dynamic RAM (SDRAM), nonvolatile/Flash-type memory, or any other type of memory. In the illustrated embodiment, program instructions included in memory 720 may be configured to implement some or all of an ANS, incorporating any of the functionality described above. Additionally, control data of memory 720 may include any of the information or data structures described above. In some embodiments, program instructions and/or data may be received, sent or stored upon different types of computer-accessible media or on similar media separate from system memory 720 or computer system 700. While computer system 700 is described as implementing the functionality of functional blocks of previous Figures, any of the functionality described herein may be implemented via such a computer system.

In one embodiment, I/O interface 730 may be configured to coordinate I/O traffic between processor 710, system memory 720, and any peripheral devices in the device, including network interface 740 or other peripheral interfaces, such as input/output devices 750. In some embodiments, I/O interface 730 may perform any necessary protocol, timing or other data transformations to convert data signals from one component (e.g., system memory 720) into a format suitable for use by another component (e.g., processor 710). In some embodiments, I/O interface 730 may include support for devices attached through various types of peripheral buses, such as a variant of the Peripheral Component Interconnect (PCI) bus standard or the Universal Serial Bus (USB) standard, for example. In some embodiments, the function of I/O interface 730 may be split into two or more separate components, such as a north bridge and a south bridge, for example. Also, in some embodiments some or all of the functionality of I/O interface 730, such as an interface to system memory 720, may be incorporated directly into processor 710.

Network interface 740 may be configured to allow data to be exchanged between computer system 700 and other devices attached to a network 785 (e.g., carrier or agent devices) or between nodes of computer system 700. Network 785 may in various embodiments include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, network interface 740 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

Input/output devices may, in some embodiments, include one or more display terminals, keyboards, keypads, touchpads, scanning devices, voice or optical recognition devices, or any other devices suitable for entering or accessing data by one or more computer systems 700. Multiple input/output devices may be present in computer system 700 or may be distributed on various nodes of computer system 700. In some embodiments, similar input/output devices may be separate from computer system 700 and may interact with one or more nodes of computer system 700 through a wired or wireless connection, such as over network interface 740.

Memory 720 may include program instructions, which may be processor-executable to implement any element or action described above. In one embodiment, the program instructions may implement the methods described above. In other embodiments, different elements and data may be included. Note that data may include any data or information described above.

Those skilled in the art will appreciate that computer system 700 is merely illustrative and is not intended to limit the scope of embodiments. In particular, the computer system and devices may include any combination of hardware or software that can perform the indicated functions, including computers, network devices, Internet appliances, PDAs, wireless phones, pagers, etc. Computer system 700 may also be connected to other devices that are not illustrated, or instead may operate as a stand-alone system. In addition, the functionality provided by the illustrated components may in some embodiments be combined in fewer components or distributed in additional components. Similarly, in some embodiments, the functionality of some of the illustrated components may not be provided and/or other additional functionality may be available.

Those skilled in the art will also appreciate that, while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 700 may be transmitted to computer system 700 via transmission media or signals such as electrical, electromagnetic, or digital signals, conveyed via a communication medium such as a network and/or a wireless link. Various embodiments may further include receiving, sending or storing instructions and/or data implemented in accordance with the foregoing description upon a computer-accessible medium. Generally speaking, a computer-accessible medium may include a non-transitory, computer-readable storage medium or memory medium such as magnetic or optical media, e.g., disk or DVD/CD-ROM, volatile or non-volatile media such as RAM (e.g. SDRAM, DDR, RDRAM, SRAM, etc.), ROM, etc. In some embodiments, a computer-accessible medium may include transmission media or signals such as electrical, electromagnetic, or digital signals, conveyed via a communication medium such as network and/or a wireless link.

The methods described herein may be implemented in software, hardware, or a combination thereof, in different embodiments. In addition, the order of the blocks of the methods may be changed, and various elements may be added, reordered, combined, omitted, modified, etc. Various modifications and changes may be made as would be obvious to a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

What is claimed is:

1. An apparatus, comprising:

a directivity speaker array which is configured to provide a plurality of separate stereo images of audio content to each of a plurality of listeners, wherein the array comprises:

a set of driver assemblies configured to:

collectively generate a signal pattern, via beamforming of separate audio signals respectively generated by separate driver assemblies of the set of driver assemblies, which is associated with a directivity index which at least meets a threshold directivity index within a first range of signal frequencies; and individually generate, by at least one driver assembly of the set of driver assemblies, another signal pattern which is associated with another directivity index which at least meets the threshold directivity index within a second range of signal frequencies;

wherein the first range of signal frequencies and second range of signal frequencies at least partially overlap, such that the set of driver assemblies is configured to transition between generating the signal pattern and the other signal pattern meeting or exceeding the threshold directivity index across the first and second ranges of signal frequencies.

2. The apparatus of claim 1, wherein:

each driver assembly of the set of driver assemblies comprises a separate driver configured to generate a separate audio signal and a release duct, coupled to the driver at a duct inlet of the release duct, which is configured to direct the separate audio signal, received from the separate driver via the duct inlet, along a particular axis.

3. The apparatus of claim 2, wherein:

the first range of signal frequencies and second range of signal frequencies at least partially overlap based at least in part upon a spacing distance between the separate duct inlets of the separate release ducts comprised in the set of driver assemblies.

4. The apparatus of claim 3, wherein:

the separate release ducts each comprise:

an enclosure which extends, from a duct inlet, along the particular axis and is bound, on opposite sides, by a surface of the enclosure and a perforated surface;

wherein, to direct the separate audio signal, received from the separate driver via the duct inlet, along the particular axis, the release duct is configured to progressively release an audio signal, which propagates from the duct inlet and along the enclosure surface through the enclosure, through perforations in the perforated surface along the particular axis as the signal propagates along the enclosure surface away from the duct inlet, such that an intensity of the audio signal is maximized along the particular axis.

5. The apparatus of claim 4, wherein:

each separate enclosure comprised in each of the separate release ducts is configured to:

progressively narrow in depth from the duct inlet of the respective release duct to a distal end of the respective enclosure; and progressively widen in width from the duct inlet of the respective release duct to the distal end of the respective enclosure.

6. The apparatus of claim 5, wherein:

the perforated surface comprises a resistive mesh material which is configured to at least partially restrict audio signal propagation through at least a portion of the mesh material.

7. The apparatus of claim 6, wherein:

the separate release ducts are comprised within an individual component, such that the individual component comprises a plurality of inlets and enclosures corresponding to the respective duct inlets and enclosures of the separate release ducts.

8. The apparatus of claim 4, wherein:

each driver assembly of the set of driver assemblies comprises a separate speaker duct configured to couple the driver to the duct inlet of the release duct and propagate audio signal generated by the driver into the release duct.

9. The apparatus of claim 8, wherein:

the separate drivers comprised in the separate driver assemblies comprise physical dimensions which exceed a spacing distance between the separate duct inlets comprised in the separate driver assemblies; and the separate speaker ducts are each curved, such that at least one of the separate drivers is positioned at a different elevation relative to at least one other driver of the separate drivers.

10. The apparatus of claim 8, wherein:

the speaker duct is curved, such that the driver is positioned at a different elevation relative to the duct inlet; and the speaker duct comprises, within an interior of the speaker duct, an internal divider which is configured to mitigate audio signal reflection within the interior over a particular range of audio signal frequencies.

11. The apparatus of claim 4, wherein each release duct comprises:

an instance of adsorptive material, located at a distal end of the enclosure relative to the duct inlet of the respective enclosure, which is configured to mitigate reflection of an audio signal, which propagates through the enclosure from the duct inlet towards the distal end, into the enclosure.

12. A non-transitory computer-readable medium storing program instructions that when executed by one or more processors cause the one or more processors to:

collectively generate a signal pattern, via beamforming of separate audio signals respectively generated by separate driver assemblies of a set of driver assemblies, which is associated with a directivity index which at least meets a threshold directivity index within a first range of signal frequencies; and individually generate, by at least one driver assembly of the set of driver assemblies, another signal pattern which is associated with another directivity index which at least meets the threshold directivity index within a second range of signal frequencies;

wherein the first range of signal frequencies and second range of signal frequencies at least partially overlap, such that the set of driver assemblies is configured to transition between generating signal patterns meeting or exceeding the threshold directivity index across the first and second ranges of signal frequencies.

13. The non-transitory computer-readable medium of claim 12, wherein:

each driver assembly of the set of driver assemblies comprises a separate driver configured to generate a separate audio signal and a release duct, coupled to the driver at a duct inlet of the release duct, which is configured to direct the separate audio signal, received from the separate driver via the duct inlet, along a particular axis.

14. The non-transitory computer-readable medium of claim 13, wherein:

the first range of signal frequencies and second range of signal frequencies at least partially overlap based at least in part upon a spacing distance between the separate duct inlets of the separate release ducts comprised in the set of driver assemblies.

15. The non-transitory computer-readable medium of claim 14, wherein:

the separate release ducts each comprise:

an enclosure which extends, from a duct inlet, along the particular axis and is bound, on opposite sides, by a surface of the enclosure and a perforated surface;

wherein, to direct the separate audio signal, received from the separate driver via the duct inlet, along the particular axis, the release duct is configured to progressively release an audio signal, which propagates from the duct inlet and along the enclosure surface through the enclosure, through perforations in the perforated surface along the particular axis as the signal propagates along the enclosure surface away from the duct inlet, such that an intensity of the audio signal is maximized along the particular axis.

16. A method, comprising:

collectively generating a signal pattern, via beamforming of separate audio signals respectively generated by separate driver assemblies of a set of driver assemblies, which is associated with a directivity index which at least meets a threshold directivity index within a first range of signal frequencies; and individually generating, by at least one driver assembly of the set of driver assemblies, another signal pattern which is associated with another directivity index which at least meets the threshold directivity index within a second range of signal frequencies;

wherein the first range of signal frequencies and second range of signal frequencies at least partially overlap, such that the set of driver assemblies is configured to transition between generating signal patterns meeting or exceeding the threshold directivity index across the first and second ranges of signal frequencies.

17. The method of claim 16, wherein:

each driver assembly of the set of driver assemblies comprises a separate driver configured to generate a separate audio signal and a release duct, coupled to the driver at a duct inlet of the release duct, which is configured to direct the separate audio signal, received from the separate driver via the duct inlet, along a particular axis.

18. The method of claim 17, wherein:

the first range of signal frequencies and second range of signal frequencies at least partially overlap based at least in part upon a spacing distance between the separate duct inlets of the separate release ducts comprised in the set of driver assemblies.

19. The method of claim 18, wherein:

the separate release ducts each comprise:

an enclosure which extends, from a duct inlet, along the particular axis and is bound, on opposite sides, by a surface of the enclosure and a perforated surface;

wherein, to direct the separate audio signal, received from the separate driver via the duct inlet, along the particular axis, the release duct is configured to progressively release an audio signal, which propagates from the duct inlet and along the enclosure surface through the enclosure, through perforations in the perforated surface along the particular axis as the signal propagates along the enclosure surface away from the duct inlet, such that an intensity of the audio signal is maximized along the particular axis.

* * * * *